US006212832B1

(12) United States Patent
Gao

(10) Patent No.: US 6,212,832 B1
(45) Date of Patent: Apr. 10, 2001

(54) SILO STRUCTURE OF VEHICLE PARKING SYSTEM

(75) Inventor: Zhuangmei Gao, 22 Yucai St., Shijiazhuang, Hebei (CN), 050021

(73) Assignee: Zhuangmei Gao, Hebei (CN)

( * ) Notice: Subject to any disclaimer, the term of this patent is extended or adjusted under 35 U.S.C. 154(b) by 0 days.

(21) Appl. No.: 08/866,874

(22) Filed: May 30, 1997

(51) Int. Cl.[7] ..... E04H 6/42
(52) U.S. Cl. ..... 52/174; 414/261
(58) Field of Search ..... 52/174; 414/227, 414/233, 252, 253, 255, 259–261, 263, 264

(56) References Cited

U.S. PATENT DOCUMENTS 3,352,436 * 11/1967 Le Vesconte et al. ..... 414/261
3,497,087 * 2/1970 Vita ..... 414/261
4,103,787 * 8/1978 Salloum ..... 414/261
4,108,322 * 8/1978 Kochanneck ..... 414/261
4,936,730 * 6/1990 Marioka ..... 414/239
4,971,506 * 11/1990 Givati ..... 414/256
4,976,580 * 12/1990 Knarick ..... 414/254
5,173,027 * 12/1992 Trevisani ..... 414/257
5,243,796 * 9/1993 Casini ..... 52/175
5,267,822 * 12/1993 Paravia et al. ..... 414/239
5,469,676 * 11/1995 Colsman ..... 52/174
5,478,182 * 12/1995 Hildebrand et al. ..... 414/261
5,674,040 * 10/1997 Wagner ..... 414/263

* cited by examiner

*Primary Examiner*—Beth A. Stephan
(74) *Attorney, Agent, or Firm*—Zhuangmei Gao

(57) ABSTRACT

The silo structure of a vehicle parking system includes multi-layers of parking floors Twelve sector-shaped parking spaces are separated equally at 30° angle intervals around the central axis of the silo structure. An elevator carrier moves vertically in the inner shaft up and down to convey a pallet with a vehicle from the entry/exit opening to parking floors. A rotary base mounted on the elevator carrier rotates 360° around the central axis. The conveyer platform, which is mounted on the rotary base, can point toward a sector-shaped parking space. A cantilever body, which moves in two opposite directions by means of a hydraulic device, extends to press the pallet hook-type lock device in the dent place in each parking space. The single piece of chain transferring device, which is mounted on the above stated conveyer platform, transfers the pallet with a vehicle in or out of the sector-shaped parking spaces. Four extending beams, which are separated at 90° intervals, can slide along the guide rails. The synchromesh device is utilized to ensure the stability and horizontal movement of the elevator carrier.

This is a novel automatic mechanical parking system which is controlled precisely and completely by computer programs.

2 Claims, 6 Drawing Sheets

FIG. 3−1
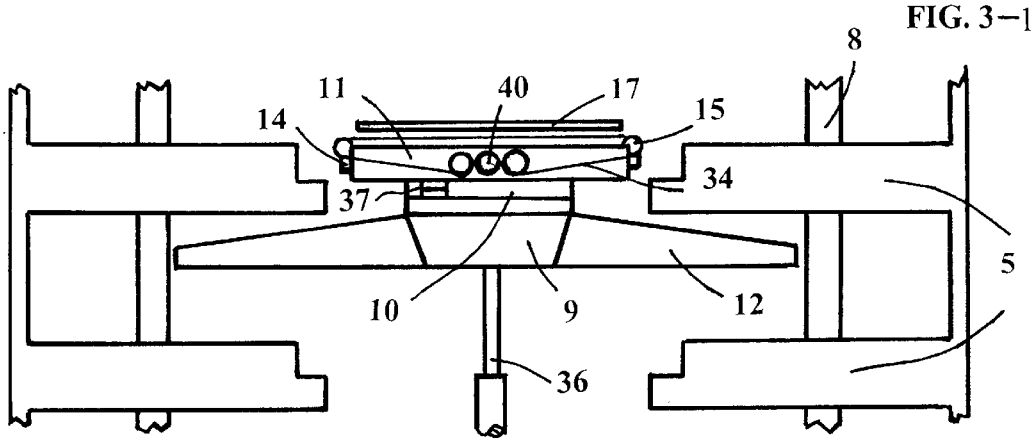
FIG. 3−2
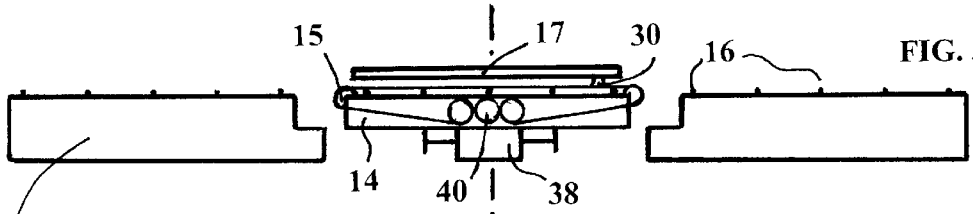
FIG. 3−3
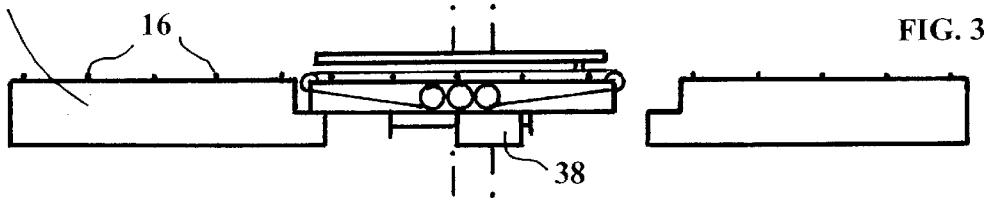
FIG. 3−4
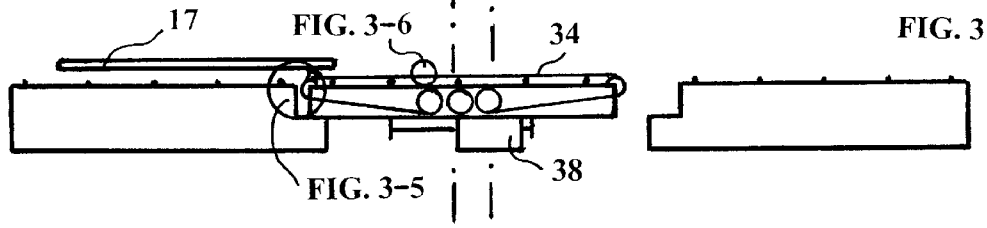
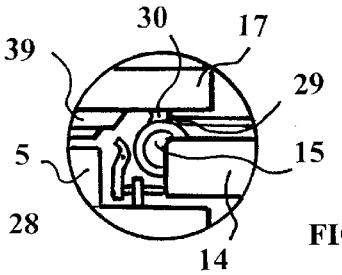
FIG. 3−5
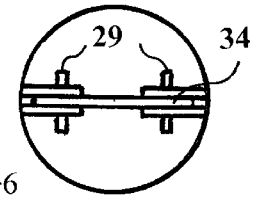
FIG. 3−6

FIG. 4-1
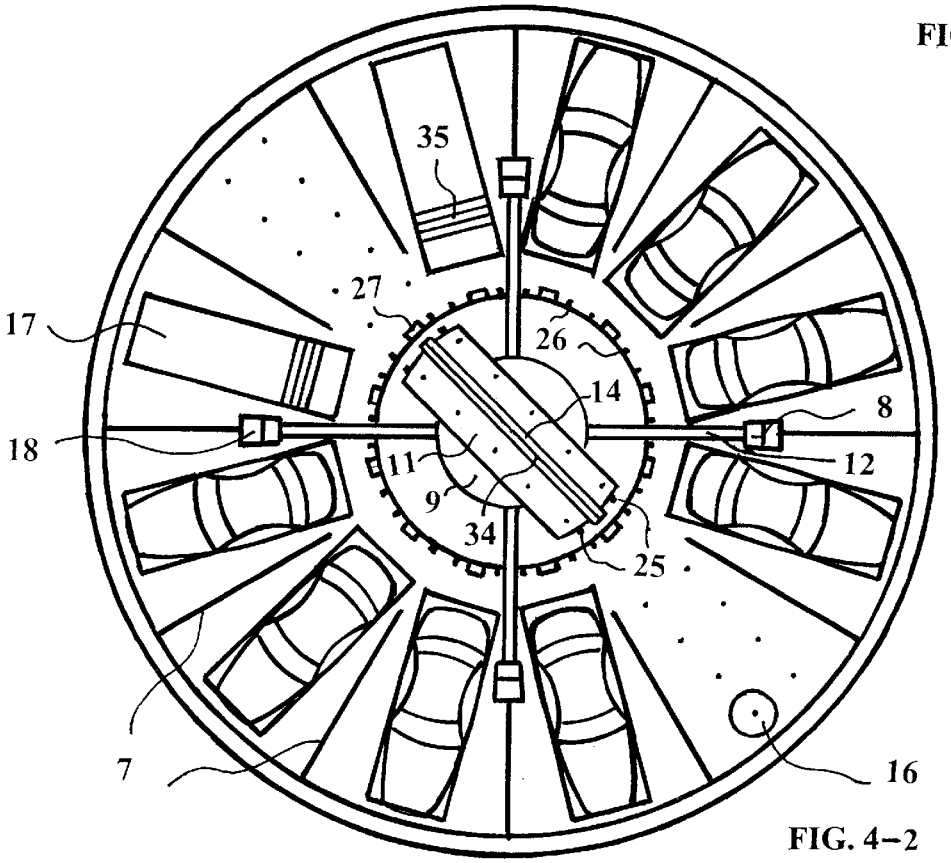
FIG. 4-2
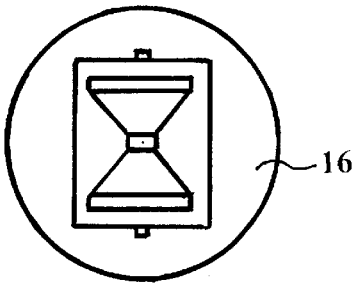
FIG. 4-2
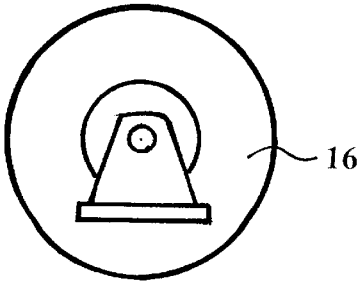
FIG. 4-3

FIG. 5-1
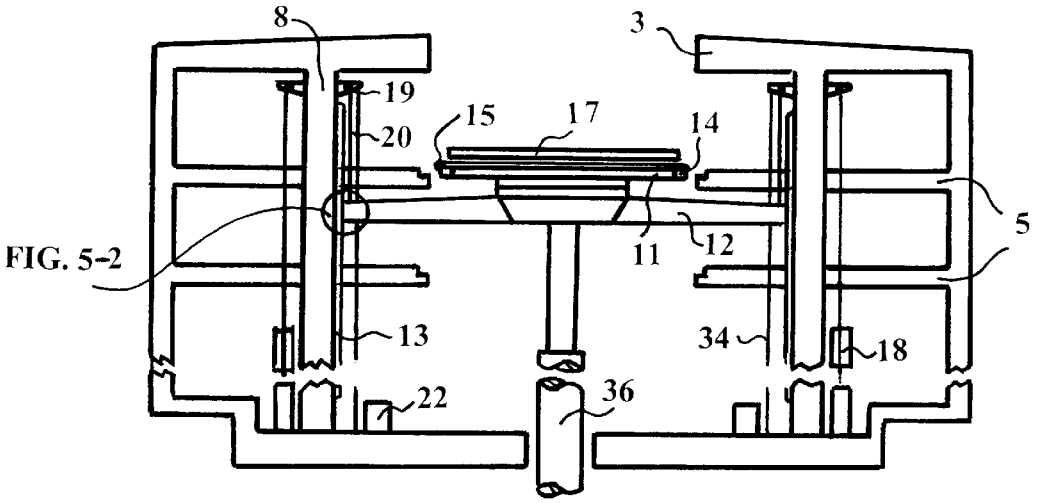
FIG. 5-2
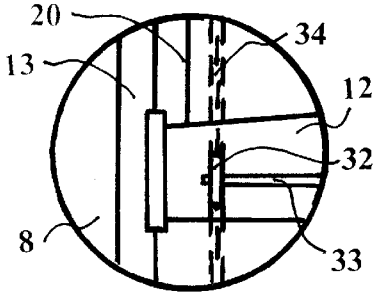
FIG. 5-3
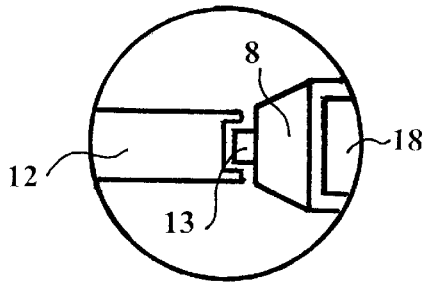
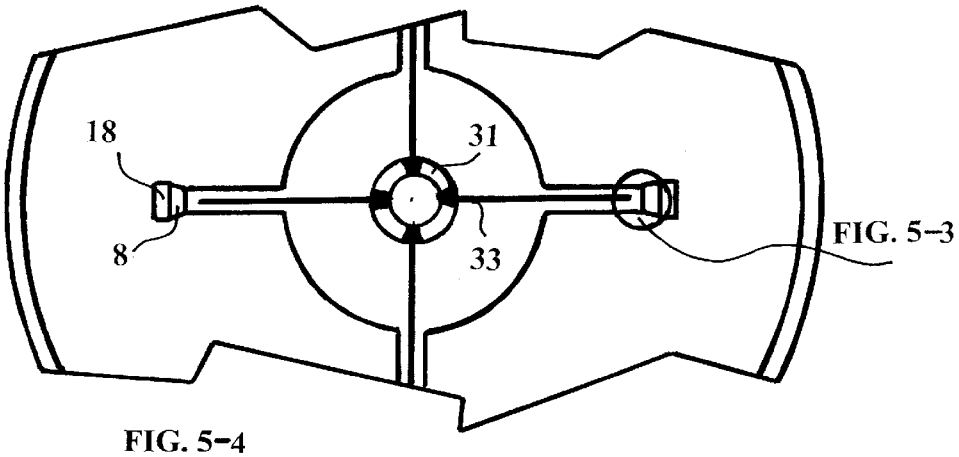
FIG. 5-4

SILO STRUCTURE OF VEHICLE PARKING SYSTEM

CROSS-REFERENCE TO RELATED APPLICATION

Not applicable

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

The present invention relates to an automatic, mechanical vehicle parking garage built as a silo structure under ground or above the ground. It has features of high efficiency in saving space and of low cost in construction, installation and maintenance.

The disadvantages of prior mechanical parking garages are mainly of two kinds. First, it has been noted that the more complicated a design, the greater possibility of mechanical malfunction in the existing inventions for automatic mechanical parking garages. Second, the principle objective of saving space is hardly obtained by the prior inventions. It would be found out that, calculating the whole construction area, few of them could make a parking space less than 25 square meters for each vehicle. Other disadvantages such as high cost for production, construction, installation and maintenance prevent the existing inventions from being practically used. All these disadvantages of the prior inventions weaken their trust in the users' mind as well as in the business market for automatic mechanical parking garages.

BRIEF SUMMARY OF THE INVENTION

The principle objective of this invention is to provide a silo structure of a vehicle parking system, which overcomes some of the disadvantages in prior inventions, by offering high efficiency in saving space, high mechanical reliability and low cost in production, installation and maintenance.

This presented silo structure of a vehicle parking system occupies no more than ten meters in height and eighteen meters in diameter; however, more than sixty vehicles could be parked in its maximum capacity. Twelve sector-shaped parking spaces on each parking floor are separated radially by partitions at 30° angle intervals. This construction design uses less than twenty square meters for each vehicle. An elevator carrier in the shaft transfers the pallet with a vehicle from the rectangular entrance/exit opening to each parking floor. A rotary base rotating 360° around the central axis can be positioned to each sector-shaped parking space.

A conveyer platform utilizing a single piece of chain transferring device transfers the pallet with vehicles into or out of the sector-shaped parking spaces.

Four beams are separated at 90° intervals to support the elevator carrier, which extend into the adjacent place between two parking spaces. These beams slide along the guide rails which are mounted on the columns to ensure the stability and horizontal movement of the elevator carrier.

A cantilever body with a single piece of chain transferring device stretches out to press a hook-type lock device located in the dent place of each parking space. The lock device is utilized to keep the pallet still in the parking place. In the meantime, the cantilever body can have the pallet to be transferred further into a parking space, clear of the shaft space.

The features of this invention are simple mechanical movement to gain the reliability and lower the cost for construction.

BRIEF DESCRIPTION OF SEVERAL VIEWS OF THE DRAWINGS

FIGS. 3-1 to 3-6 are group of drawings. FIGS. 3-1 to 3-4 showing the conveyer platform, the cantilever body, the chain transferring device. FIG. 3-5 is an enlarged side view showing the hook-type lock device, and the push-pull block. FIG. 3-6 is an enlarged bird's view showing the pins on the chain joints.

FIGS. 4-1 to 4-3 are a group of drawings. FIG. 4-1 is a plan view showing the conveyer platform, the cantilever body, the positioners, the dent place and two rows of "V"-shaped rollers. FIG. 4-2 is an enlarged bird's view of the "V"-shaped rollers and FIG. 4-3 is an enlarged side view of a "V"-shaped roller.

FIGS. 5-1 and 5-3 are group of drawings.

FIG. 5-1 is a sectional view showing the elevator carrier, the hydraulic device for raising and lowering the elevator carrier, the synchromesh device, steel cable and the counterweights with pulleys.

FIG. 5-2 is an enlarged view showing the synchromesh device of chain, rack wheel and transmission shaft.

FIG. 5-3 is an enlarged view showing the columns, the guide rail and the counterweight positions.

FIG. 5-4 is a plan view showing the synchromesh device.

FIG. 6 is a rear view showing the "V"-shaped rollers, the pull-push block, the dent place the positioner holes.

DETAILED DESCRIPTION OF THE INVENTION

Figure 1:
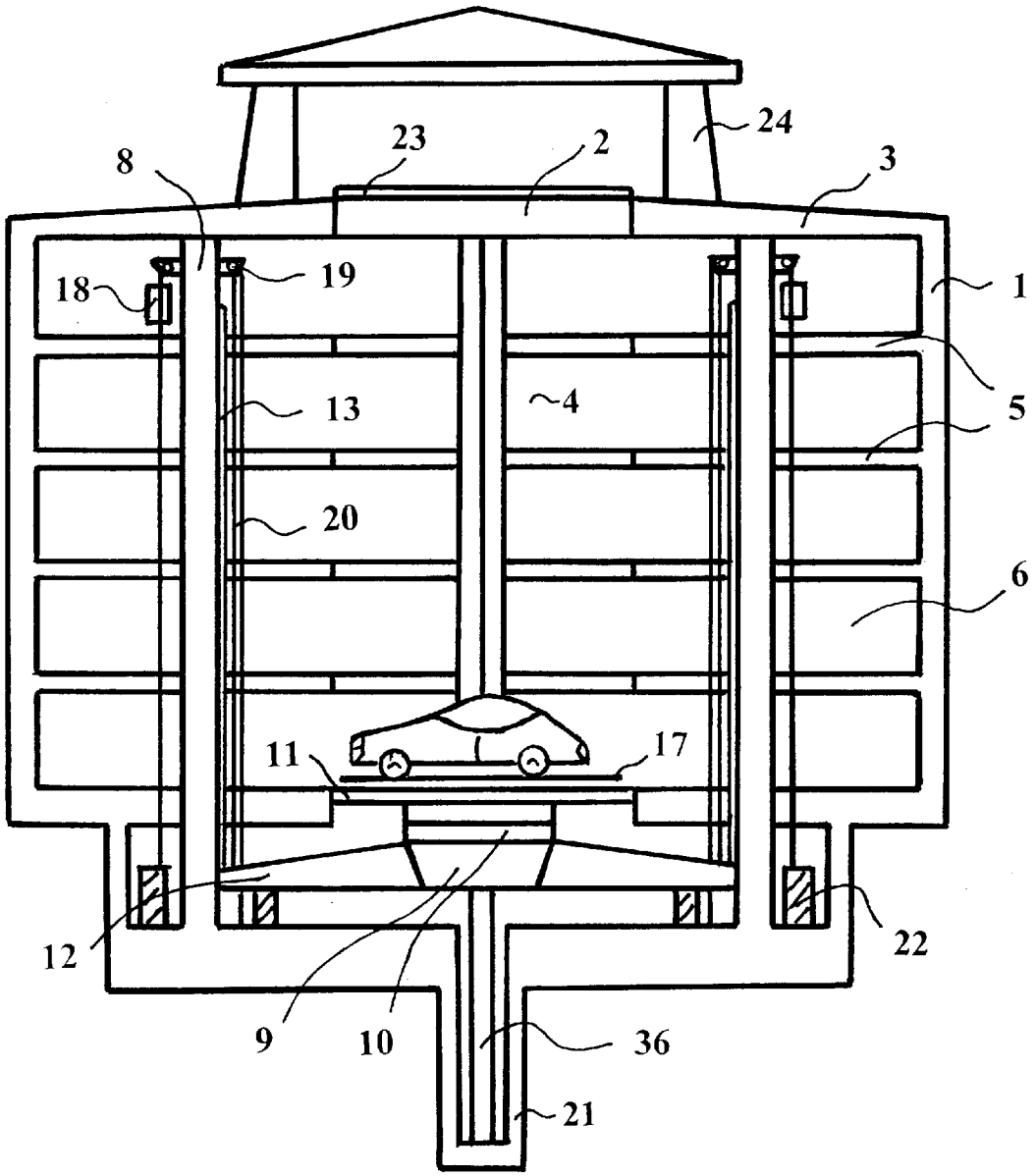
FIG. 1 is a vertical section view of the silo structure of a vehicle parking system.

The silo structure of a vehicle parking system provides a cylindrical structure (1) (FIG. 1), which is built either under the ground or above the ground (the presented embodiment is of underground). The above stated vehicle parking system comprises a rectangular entrance/exit opening (2) on the up roof (3) (FIG. 1) at the ground level, a circular shaft space (4) beneath the entry/exit opening (2), multi-layers of parking floors (5), twelve sector-shaped parking spaces (6) (FIG. 2 **6*a* to 6*i*, which are facing the inner circular shaft space (4), and separated equally and radically by partitions (7) (FIG. 2 and FIG. 4-1) at 30° angle intervals about the central axis of the silo structure (1). Four columns (8) (FIG. 2 and FIG. 4-1) equipped with guide rails (13), on which four extending beams (12) connected with the elevator carrier (9)**, can slide vertically up and down.

The elevator carrier (9) comprises a rotary base (10), a conveyer platform (1), on which a cantilever body (14) (FIGS. 3-1 to 3-4 and FIG. 4-1) with a chain transferring device (15) is located. The chain transferring device is mounted on the cantilever body (14).

Figure 2:
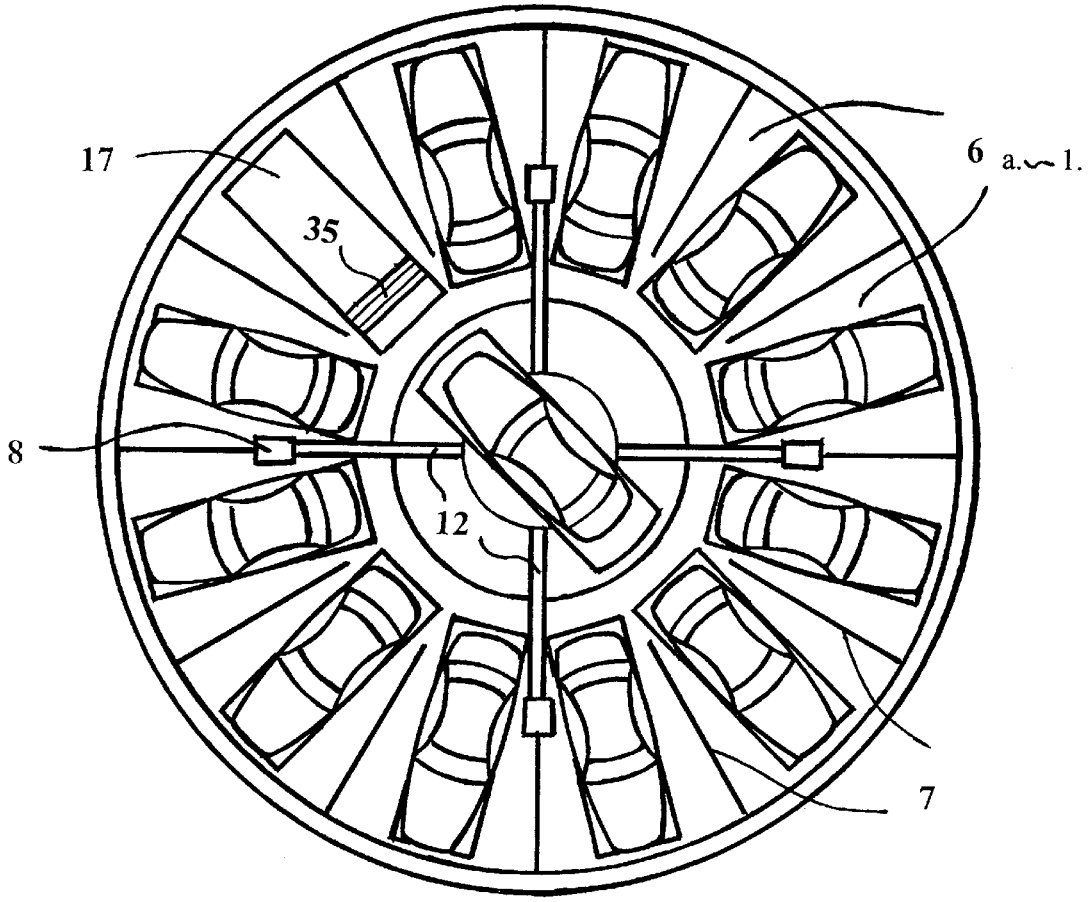
FIG. 2 is a plan view of a parking floor showing twelve sector-shaped parking spaces and the locations of the four columns.

The rotary base (10) with the conveyer platform (11) rotates 360° about the axis and can be positioned toward any one of the sector-shaped parking spaces (FIG. 2), which is driven by a motor-driven device (37) (FIG. 3-1).

The above stated cantilever body (14) (FIGS. 3-1 to 3-4) can stretch out in opposite directions by means of hydraulic device (38) (FIGS. 3-1 to 3-4).

Two rows of "V"-shaped rollers are located on the floors of each sector-shaped parking space (FIG. 4-1) for receiving the male "V"-shaped steel bars (39) (FIG. 6), which are mounted at the bottom side of the pallet. The "V"-shaped rollers located both on the floor and the conveyer platform are aligned with each other in parallel (FIG. 4-1).

The standby status of the silo structure of a vehicle parking system is that the elevator carrier is positioned at a computerized level in the shaft without the pallet on.

When a parking order is confirmed, the elevator carrier (9) moves to a parking floor (5). The rotary base (10) equipped with conveyer platform (11) turns to point at a vacant parking space. Two pairs of hydraulic positioner (25) (FIG. 4-1) located at the conveyer platform (11) are positioned into the holes (26). The cantilever body (14) stretches out into the dent place (27) to press the pallet hook-type lock device (28) (FIG. 3-5) to be in unhooked position. The chain transferring device (15), which is driven by the chain traction wheel (40) (FIG. 3-1 to 3-5) transfers the vacant pallet out of the parking space onto the "V"-shaped rollers which are mounted on the conveyer platform, then the elevator carrier transports the pallet up to the entry-exit opening (2).

The vehicle is driven onto the pallet with its rear wheels in the grooves (35) (FIG. 4-1), then the elevator carrier transports the pallet with a vehicle vertically down to the parking floor. The rotary base equipped with the conveyer platform turns to point toward the above stated vacant parking space. Two pairs of the stated hydraulic positioners (25) are positioned in the holes again. The cantilever body (14) stretches out into the dent place to press the pallet hook-type lock device to be in unhooked position, then the chain transferring device (15) transfers the pallet with a vehicle into the parking space.

Figure 6:
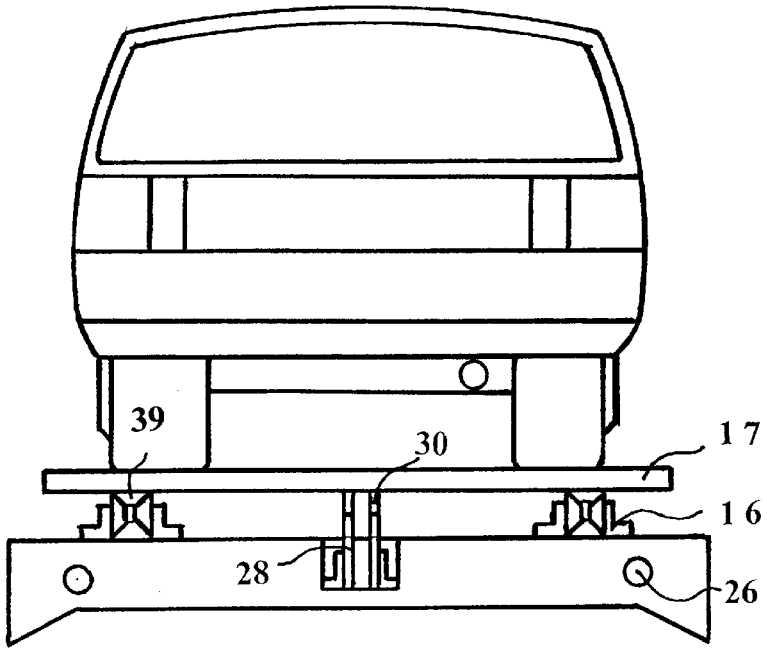

The conveyer platform (11) comprise a cantilever body (14), a single piece of chain transferring device (15) (FIGS. 3-1 to 3-6) and two rows of "V"-shaped rollers (16) (FIG. 4-1) arranged in parallel which are utilized to support and transfer the pallet (17) (FIG. 6).

Four counterweights (18) (FIG. 5-1) are provided to keep the balance of the elevator carrier (9), which are connected to the four extending beams (12) by four pieces of steel cables (20), guiding to the rear side of the columns by pairs of pulleys (19) through the prepared holes (FIG. 5-1).

The elevator carrier is raised and lowered by the hydraulic device (36), which is located in the pit (21) at the bottom of the shaft (4) (FIG. 1).

The buffers (22) are placed at the lower level of the silo structure to absorb accident shocks (FIG. 1).

Figure 7:
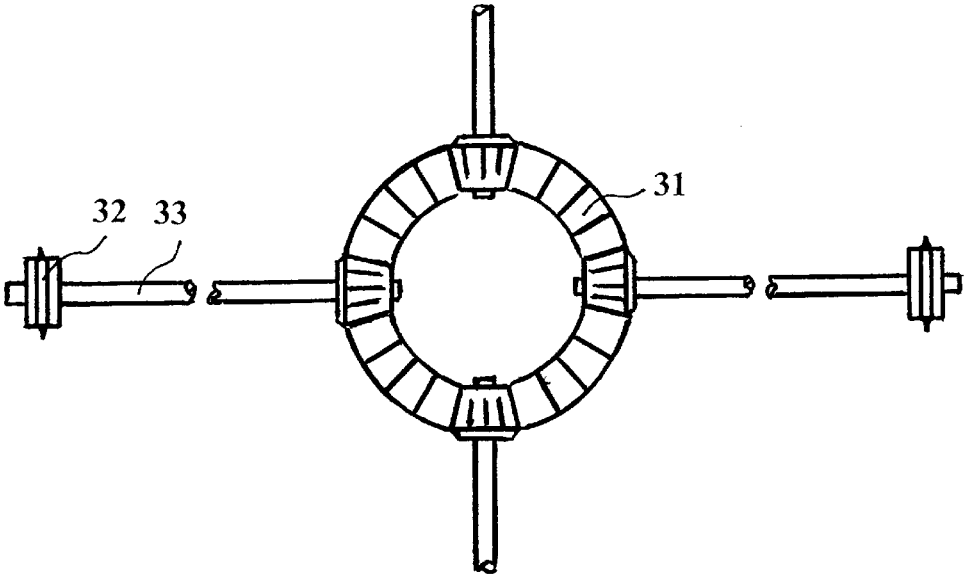
FIG. 7 is a plan view of the synchromesh device showing gears and the transmission shafts.

The synchromesh device (31) (FIG. 5-4 and FIG. 7) is necessary to be utilized to keep the four extending beams of the elevator carrier moving horizontally, which is by means of rack wheel (32) fixed with transmission shafts (33) engaged with chains (34) (FIG. 5-3).

A safe cover (23) shaped as the size of the entry/exit opening (2) slides along the guide poles (24), which is provided to prevent anyone from falling into the shaft space when the elevator carrier moves down.

The pallet is transported by means of a pair of specially designed axis pins (29) (FIG. 3-6) on the chain joints, which gets contacting with the block (30) (FIG. 3-5) mounted at the bottom of the pallet to pull or push the pallet into or out of a parking place.

The single piece of chain transferring device is driven by the chain traction wheel (40) (FIG. 3-1), which is mounted on the cantilever body. After the cantilever body retrieves back to the given position, the parking system is in its standby status again.

The simplified mechanical system and high efficiency in saving space will make this invention possible to get into business market. The features of low cost and durable reliability of this parking system are assured to attract more users in the coming century.

LIST OF REFERENCE NUMBERS:

1. Silo structure of a vehicle parking system
2. Entry/Exit of opening for vehicles
3. Roof (at the ground level)
4. Shaft space
5. Parking floor
6. Sector-shaped parking space
7. Partition
8. Column
9. Elevator carrier
10. Rotary base
11. conveyer platform
12. Extending beam
13. Guide rail
14. Cantilever body
15. Chain transferring device
16. "V"-shaped roller
17. Pallet
18. Counterweight
19. Pulley
20. Cable
21. Pit
22. Buffer
23. Safe cover
24. Guide pole
25. Positioner
26. Positioner hole
27. Dent place
28. Hook-type lock device
29. Axispin
30. Pull-push block
31. Synchromesh
32. Rack wheel
33. Transmission shaft
34. Chains (transferring and synchromesh)
35. Groove
36. Hydraulic device (raising and lowering the elevator carrier)
37. Motor-driven device
38. Hydraulic device (for cantilever body's moving in opposite directions)
39. Male "V"-shaped steel bar
40. Chain traction wheel

What is claimed is:

1. A silo structure of a vehicle parking system comprises:

multi-layers of parking floors in the silo structure underground or above the ground, twelve sector-shaped parking spaces separated equally at 30° intervals in said silo structure on each floor, an elevator carrier welded with four horizontal extending beams moving togeher vertically up and down along four vertical columns in said silo structure a cantilever body and a conveyer platform located on a rotary base directed towards one of said sector-shap parking spaces a chain transferring device mounted on said cantilever body conveying a pallet with a vehicle sliding the pallet onto two rows of "V"-shaped rollers in or out of one of said sector-shaped parking spaces.

2. A silo structure of a vehicle parking system, according to claim 1, comprises:

the two rows of "V"-shaped rollers located in parallel on each parking floor for receiving a pair of male "V"-shaped steel bars for said pallet to slide in or out of said sector-shaped parking spaces;

a synchromesh device located in said extending beams keeping said elevator carrier and said extending beams moving together horizontally by means of rack wheels fixed with transmission shafts engaged with chains;

said cantilever body mounted on said conveyer platform transferring a pallet into or out of one of said parking spaces across a gap between the parking floors and the said conveyer platform by means of a chain transferring device;

a pair of axis pins on joints of said of chain transferring device contacting a pull-push block mounted at a bottom of the pallet during movement of the pallet with one of said vehicle into or out of a parking spaces.

* * * * *